United States Patent [19]

Bolduc

[11] Patent Number: 4,893,730

[45] Date of Patent: Jan. 16, 1990

[54] AEROSOL DISPENSER FOR DUAL LIQUIDS

[76] Inventor: Lee R. Bolduc, 6416 Gainsborough Dr., Raleigh, N.C. 67612

[21] Appl. No.: 214,477

[22] Filed: Jul. 1, 1988

[51] Int. Cl.[4] ..... B67B 7/24

[52] U.S. Cl. ..... 222/80; 169/83; 169/85; 206/219; 222/136; 222/145; 222/402.1

[58] Field of Search ..... 222/80, 94, 135, 136, 222/145, 183, 394, 402.1, 541; 169/81, 83, 85, 30; 239/304, 309; 206/219, 221; 215/DIG. 8

[56] References Cited

U.S. PATENT DOCUMENTS

| | | | |
|---|---|---|---|
| 315,610 | 4/1885 | Gee | 169/83 |
| 470,293 | 3/1892 | Durand | 169/83 |
| 549,617 | 11/1895 | Stempel | 169/83 |
| 662,786 | 11/1900 | Harris | 169/83 |
| 1,587,598 | 6/1926 | Magg | 169/83 |
| 1,779,959 | 10/1930 | Bellocchio | 169/83 |
| 3,240,403 | 3/1966 | Modderno | 169/85 X |
| 3,491,916 | 1/1970 | Graham | 222/80 |
| 3,591,089 | 7/1971 | Cronan | 222/83 X |
| 3,648,899 | 3/1972 | Lukesch et al. | 222/136 X |
| 3,718,235 | 2/1973 | Cronan | 222/145 |
| 3,773,264 | 11/1973 | Cronan | 222/145 X |
| 3,964,643 | 6/1976 | Morane et al. | 222/145 |
| 4,121,772 | 10/1978 | Cronan | 222/145 X |
| 4,201,316 | 5/1980 | Klingaman | 222/136 X |
| 4,779,763 | 10/1988 | Klawitter | 222/136 X |

FOREIGN PATENT DOCUMENTS

| | | | |
|---|---|---|---|
| 6947 | 6/1893 | Fed. Rep. of Germany | 169/83 |
| 252385 | 3/1927 | Italy | 169/83 |
| 305174 | 1/1933 | Italy | 169/83 |

OTHER PUBLICATIONS

Aerosol Age, Apr. 1986.

*Primary Examiner*—Kevin P. Shaver
*Attorney, Agent, or Firm*—Burd, Bartz & Gutenkauf

[57] ABSTRACT

An aerosol dispenser has a container with a deformable side wall and an internal chamber storing a propellant and a component to be sprayed through a discharge nozzle. A control valve mounted on the top of the container regulates the flow of fluid through the nozzle. A frangible ampule storing a second component is retained in the chamber adjacent a portion of the side wall. The ampule can be broken with a lever mounted on the outside of the container in alignment with the ampule. The lever is manually moved to deform the side wall and break the ampule so that the component in the ampule is mixed with the fluid in the chamber.

25 Claims, 2 Drawing Sheets

AEROSOL DISPENSER FOR DUAL LIQUIDS

FIELD OF THE INVENTION

The invention relates to an aerosol container for holding chemicals that normally must be maintained in separated condition until immediately prior to use.

BACKGROUND OF INVENTION

Many compounds would be advantageously used if they could be dispensed from an aerosol container. Some of these compounds have a relatively short life and cannot be intermixed until just prior to use. Aerosol containers that include a frangible secondary container have been used to hermetically separate two chemical ingredients that must be mixed together immediately prior to spraying such as a resinous paint and a catalyst. An inertia means, such as a steel ball, is provided in the secondary container so that by shaking the entire aerosol container the inertia means shatters the secondary container allowing the two chemicals to be mixed together allowing a chemical mixture to be sprayed to a desired location. An example of this structure is shown by Cronan in U.S. Pat. No. 4,121,772.

An aerosol package shown and described in Aerosol Age April 1986 has an ampule that keeps the reactive compounds in the system separated until ready for use. When the valve is actuated, the ampule is broken and its contents mix with other chemicals and/or a propellant. The ampule is made of a frangible material, such as glass. A rod mechanism extends from the valve downwardly into the container. The lower end of the rod has a saddle that traps the ampule against the bottom of the container. When the valve stem is depressed, the rod shatters the ampule. This aerosol system allows one to use an aerosol spray containing material such as cyanoacrylates. This material causes rapid deteriation of gaskets and has a relatively short shelf life. The size of the ampule lying on the bottom of the container is limited by the diameter of the container and the diameter of the opening into the container. This limits the amount of material in the ampule that can be mixed with the material in the container. This aerosol container uses internally concealed structure to open or break the internal ampule.

SUMMARY OF INVENTION

The invention is an aerosol dispenser for storing two or more chemicals in separate containers and maintaining the separated condition of the containers until immediately prior to use. The first container has an enclosed internal chamber for accommodating a propellant and a chemical in liquid form. A sealed second container or ampule is located within the chamber and positined adjacent a side wall of the container. The ampule stores a second chemical in liquid form in a selected quantity which is to be mixed with the liquid in the container to form a desired chemical mixture. A normally closed control valve is mounted on top of the container to retain the propellant and chemicals within the container. The control valve is movable to an open position to dispense an aerosol spray to a desired location. The ampule located adjacent the deformable side wall of the container is crushed or broken with a manually operated lever mounted on the outside of the container side wall in alignment with the ampule. The lever is moved to deform the side wall toward the ampule which crushes the ampule thereby releasing the second chemical into the chamber of the container. The control valve is operated in a normal manner to selectively commence and terminate the spraying of the chemicals to a desired location.

A preferred embodiment of the aerosol dispenser has a generally cylindrical container with a deformable side wall surrounding an enclosed internal chamber for storing a propellant and at least one first component, including a first liquid. A normally closed valve is mounted on top of the container to retain the propellant and liquid in the chamber of the container. The valve has a movable stem that cooperates with a ceiling diaphram that normally closes a valve cord that controls the dispensing of a liquid spray from the dispenser. The valve stem is movable relative to the diaphram to open the cord to allow the liquid under pressure to be dispensed through a nozzle mounted on top of the stem. An elongated frangible ampule, such as glass ampule, is located in the chamber and stores a second liquid in a manner separating it from the first liquid within the chamber until the ampule is broken. A split band located within the chamber has a loop that grips the ampule and locates the ampule adjacent the side wall of the container. The loop holds the ampule a short distance away from the side wall of the container. A lever having a downwardly directed lip and an upper nose is located adjacent the outside of the side wall of the container in alignment with the ampule. A retainer means surrounding the container is connected to the lever to hold the lever in the tight relation to the side wall of the container. The retainer means includes a wire that surrounds the side wall in alignment with the band. The lip of the lever is pivoted in an upward direction along an axis that is generally parallel to a tangent of the side wall by moving the nose into the side wall and deforming the side wall into crushing engagement with the ampule thereby releasing the second liquid in the ampule into the chamber. The liquids are mixed in the chamber prior to their use by shaking the container. The control valve is used in a normal manner to selectively control the dispensing of the mixed liquids as a spray from the nozzle. The material in the ampule being separated from the material in the container increases the shelf life of the product and minimizes the deteriation of the gasket and seal structures of the control valve. The external activator lever provides the merchant and customer with visual indication of the condition of the ampule within the container. If the side wall of the container is not deformed or crushed inwardly the integrity of the ampule is within the container verified.

The objects and advantages of the aerosol dispenser of the invention are embodied in the aerosol dispenser as shown in the drawing and described in the description of a prefered embodiment.

DESCRIPTION OF PREFERRED EMBODIMENT

Figure 1:
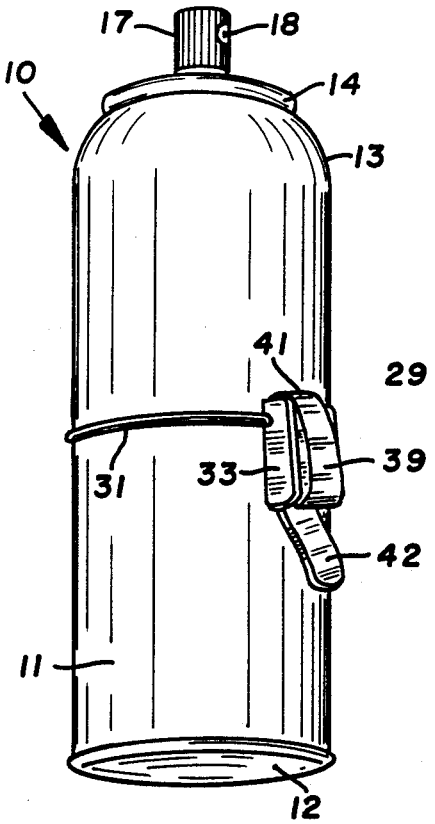
FIG. 1 is a prospective view of an aerosol container equipped with an internal ampule containing a second fluid and a manually operated external lever for breaking the ampule.
Figure 2:
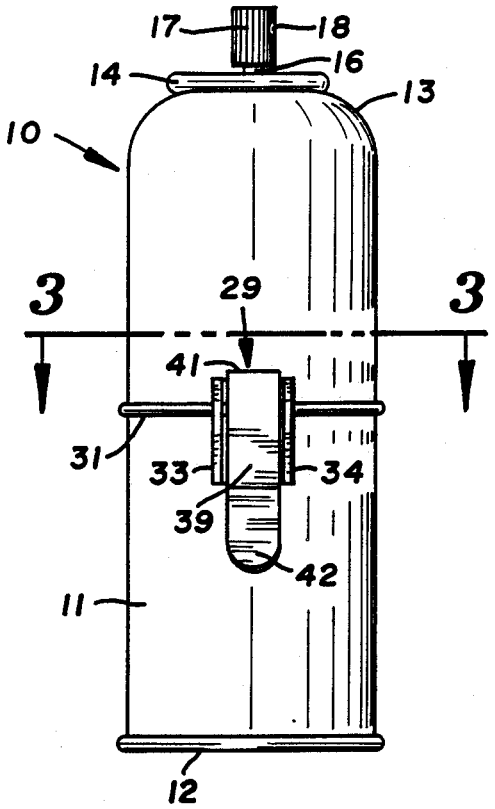
FIG. 2 is a front elevational view thereof.
Figure 3:
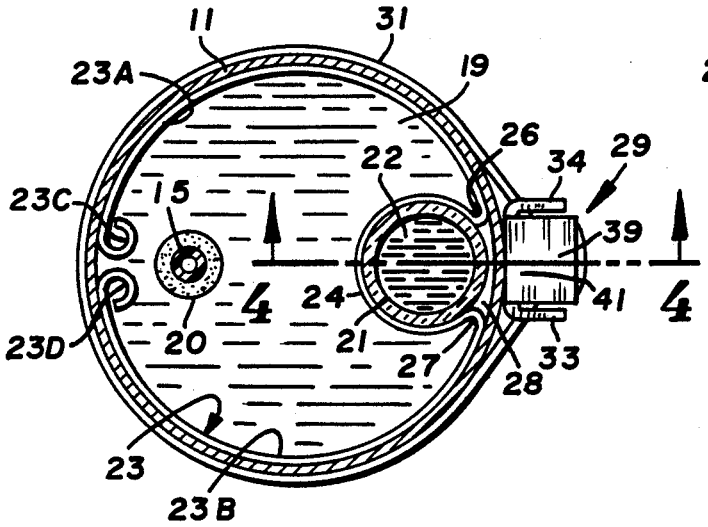
FIG. 3 is an enlarged sectional view taken along the line 3—3 of FIG. 2.

Referring to FIGS. 1 and 2, there is shown an aerosol container indicated generally at 10 for storing propellants and chemical components as liquid under pressure or like materials. Container 10 has an elongated cylindrical deformable side wall 11 joined to a generally circular bottom wall 12. The top of side wall 11 converges inwardly to form rounded inwardly directed top wall 13. Container walls 11, 12, and 13 are deformable or bendable metal, such as aluminum or sheet metal. Other bendable materials including plastic can be used to make container 10. The wall can be deformed inwardly without causing a hole or slip therein to maintain the liquid in the container. Wall 13 has a circular hole that is closed with a cap 14. Center of cap 14 accomodates a manually operated control valve 50, shown in FIG. 7. The details of control valve 50 are hereinafter described. A button 17 with a laterally located discharge nozzle 18 is mounted on top of a stem 16. A long dip tube 15, shown in FIG. 3, is joined to the valve and extends to the bottom of container 10. A filter 20 is mounted on the lower end of tube 15 to prevent glass particulates from interfering with the operation of control valve 50 and being ejected with the spray. In use, button 17 is depressed to open valve 50 whereby the fluid under pressure in container chamber 19 flows through tube 50, the open valve, and tube 16 and is dispensed as a spray laterally from nozzle 18. Container 10, the control valve 50 and dispensing button 17 with nozzle 18 are conventional aerosol container structures.

Figure 4:
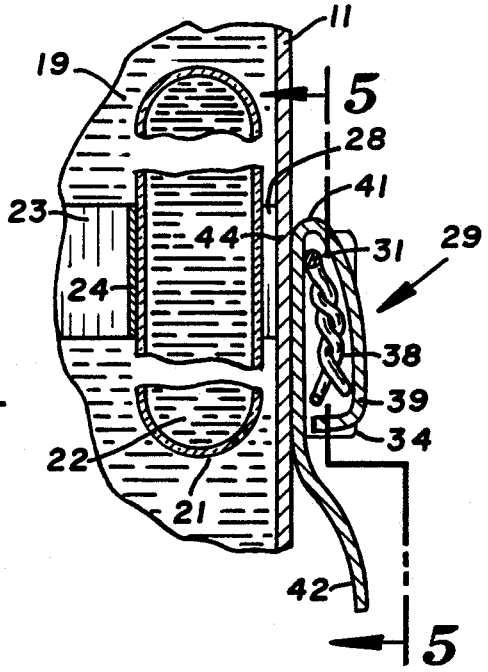
FIG. 4 is an enlarged sectional view taken along the line 4—4 of FIG. 3.

Referring to FIGS. 3 and 4, an upright generally cylindrical ampule 21 is located within container chamber 19. The ampule 21 is located in the generally upright position parallel to the longitudinal or upright axis of chamber 19 container 10. This allows the use of a long ampule to store a second component or chemical composition as liquid 22 or like materials which is to be mixed with the first liquid within the container prior dispensing of aerosol from the container. Ampule 21 is generally a cylindrical glass tube or vessel having closed ends which prevent the mixing of the first and second liquids. Ampule 21 is a hermetically sealed vessel or flask that is made of breakable or frangible materials. The diameter and length of ampule 21 may vary to provide for different concentrations or mixtures of the first and second liquids within container 10.

As seen in FIG. 3, ampule 21 is retained in its upright position in contiguous or adjacent relationship relative to side wall 11 of container 10 with a retaining clip 23. Clip 23 is a C-ring or split circular band having an inwardly directed loop 24 that surrounds a mid-section of ampule 21. Loop 24 has a circumferential extent of about 270 degrees and adjacent reversed turned ends 26 and 27 that hold the ampule 21 a short distance away from side wall 11. The band loop 24 circumferentially grips the outer peripheral wall of ampule 21. The semicircular arms of 23A and 23B band 23 squeeze loop 24 about ampule 21. The arms 23A and 23B are biased outwardly into tight engagement with the inside of side wall 11. The biasing force of arms 23A and 23B also holds ends 26 and 27 adjacent ampule 21 to maintain the space relationship between ampule 21 and side wall 11. An expoxy, adhesive and the like can be used to secure arms 23A and 23B to side wall 11. The split band 23 is threaded through the top hole in container before the cap 14 and valve 50 are mounted thereon. The adjacent ends 23C and 23D of band 23 have loops or curls to accomodate a tool used to curl the band into a tight coil. The tight coil fits through the top hole of the container. When the tool is removed the band 23 expands into engagement with side wall 11. As seen in FIGS. 3 and 4, a small spaced 28 separates the outside of ampule 21 from the side wall 11. This prevents ampule 21 from rubbing against wall 11 and minimizes the inadvertant breaking of the ampule during handling, shipping, and storage of container 10. Band 23 can be one or more wires having loops to hold ampule 21.

Figure 5:
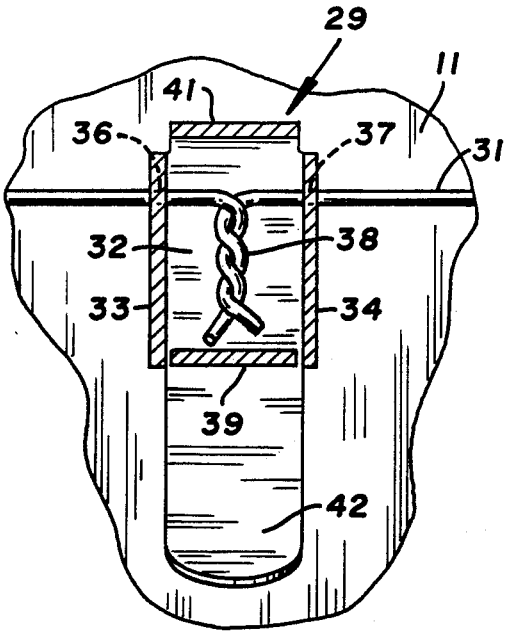
FIG. 5 is a sectional view taken the line 5—5 of FIG. 4.
Figure 6:
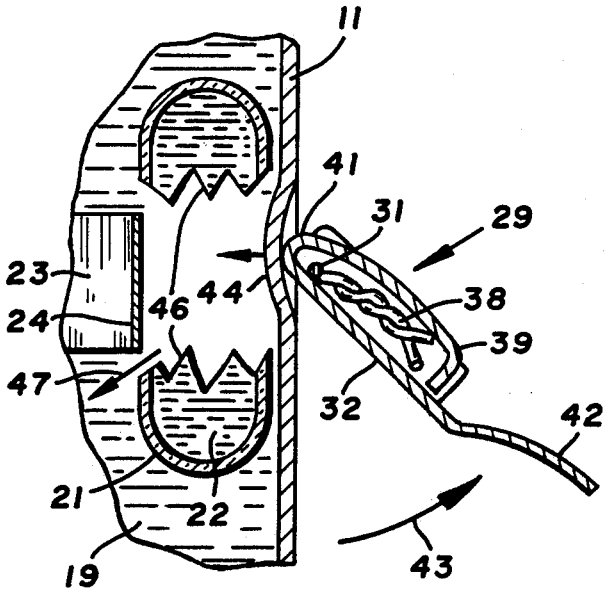
FIG. 6 is a sectional view similar to FIG. 5 showing the breaking of the ampule with the manually operated lever.

An ampule crushing or breaking device indicated generally at 29 is located externally on side wall 11 of container 10 adjacent ampule 21. Device 29 is a manually operated lever or tab that is retained in assembled relation with side wall 11 with a ring or wire 31. Wire 31 is aligned with band 23 and minimizes the outward and inward deformation of bending of side wall 11. Wire 31 also holds device 29 in lateral alignment with the side of ampule 21, as seen in FIGS. 3 and 4. Device 29 has generally a U-shaped body 32 with outwardly directed upright side flanges 33 and 34. Side flanges 33 and 34 have aligned holes 36 and 37 for accomodating the opposite ends of wire 31. As seen in FIGS. 4 and 5, the ends of wire 31 are twisted together to form a connection 38 which is located between the flanges 33 and 34. The twisted connection 38 holds the wire 33 in a tight position about side wall 11. After the twisted connection 38 is made it is confined within body 32 under a cover 39. The forward or upper end of cover 39 has a convex curved nose 41 located above wire 31 adjacent side wall portion 44. The lower portion of body 32 is joined to a downwardly and outwardly curved tab 42 which provides a finger grip for pivoting lever 29 in an outward direction as indicated by arrow 43 in FIG. 6. When lever 29 is in the down position, as shown in FIGS. 1 to 4, ampule 21 has not been broken. This provides the merchant and consumer with visual inspection of the condition of the container. Movement of lever 29 away from the side of the container forces nose 41 to pivot into engagement with a side wall portion 44. Lever 29 pivots on wire 33 about an axis that is generally parallel to a tangent to side wall 11 of the container. Continued movement of lever 29 in an outward direction will force nose 44 to dent or move side wall portion 44 into an engagement with ampule 21. The inward force on side wall portion 44 is sufficient to break the ampule as shown at FIG. 6. The liquid 22 in ampule 21 will flow into and mix with liquid 19 as indicated by the arrow 47. The lever 29 can then be moved back into a generally parallel position with side wall 11. Container 10 is then shaken to insure a thorough mixture of liquids 19 and 22. Button 17 is pushed down to open control valve 50 which permits the dispensing of the aerosol spray through nozzle 18.

Figure 7:
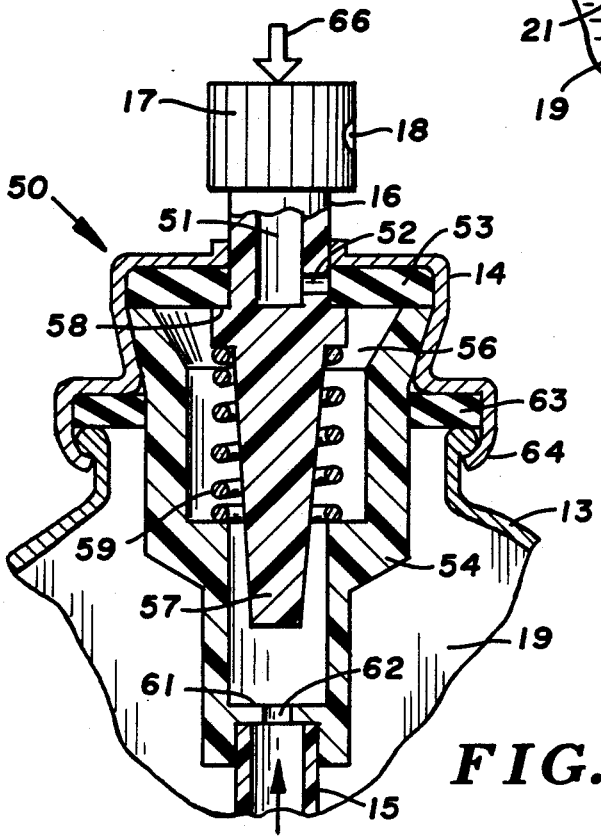
FIG. 7 is a vertical view of the control valve used with the aerosol container of FIG. 1.

Referring to FIG. 7 control valve indicate generally at 50 is mounted on the top wall 13 of the container with cap 14. Valve 50 includes the upwardly directed stem 16 having a passage 51 open to the button 17. The lateral port 52 is open to the bottom of passage 51. Port 52 is normally closed with a diaphram 53 made of neoprene rubber. Diaphram 53 is retained on the top of a cup shaped body 54 with cap 14. Body 54 has an internal chamber 56 that surrounds the base 57 of the stem 16. The mid-portion of the stem 16 has a outwardly directed annular shoulder 58 that engages the bottom of diaphram 53. A coil spring 59 contacting the shoulder 58 and body 54 biases the stem in an outward direction to normally hold the port 52 in a closed position as shown in FIG. 7. The lower part of body 54 has an inwardly directed flange 61 having a central hole 62 leading to the dip tube 15. An annular gasket 63 surrounds body 54 and is clamped onto the top of container 13 with an inwardly turned 64 of cap 14. Valve 50 is moved to an open position by applying downward pressure as indicated by arrow 66 to button 17. This moves port 52 below diaphram 53. The fluid under pressure in container chamber 19 will flow up through dip tube 15 through chamber 56, port 52, passage 51 to be discharged through nozzle 18 to a desired location. The control valve 50 is shown as an example of a normally closed valve used with aerosol containers. Other types of control valves can be used with an aerosol dispenser of the invention.

While there has been shown and described of preferred embodiment of the aerisol dispenser of the invention it is understood that changes in the structures, arrangement of structures, and materials may be made by those skilled in the art without departing from the invention. The invention is defined in the following claims.

I claim:

1. An aerosol dispenser comprising: a container having a deformable side wall and an internal chamber for storing a propellant and at least one first component to be sprayed therefrom, normally closed valve means mounted on said container to retain the propellant and component in said chamber, said valve means being movable to an open position to dispense aerosol to a desired location, frangible ampule means located within said chamber containing a second component that is separated from the first component within the chamber until said ampule means is broken, means for holding the ampule means in said chamber adjacent a portion of the side wall of the container, said means for holding the ampule means in said chamber includes means having a loop surrounding a portion of the ampule means to hold said ampule means in said chamber adjacent said portion of the side wall, a first arm, and a second arm positioned in engagement with the inside of said side wall, said loop having ends joined to the first and second arms, said ends spacing the ampule means from said portion of the side wall, and means mounted on said container engagable with said portion of the side wall and operable to deform said portion of the side wall toward the ampule means to break said ampule means thereby releasing the second component into said chamber.

2. The dispenser of claim 1 wherein: said ampule means is a generally cylindrical sealed vessel holding a chemical including said second component, said vessel having a longitudinal axis generally parallel to the longitudinal axis of said chamber.

3. The dispenser of claim 1 wherein: said means mounted on said container includes ring means surrounding the side wall of the container, and movable means cooperating with the ring means to deform said portion of the side wall to break said ampule means.

4. The dispenser of claim 3 wherein: said first and second arms are in general alignment with said ring means.

5. The dispenser of claim 1 wherein: the means mounted on said container includes lever means having a lip and a nose, and retainer means mounted on the container and connected to the lever means between the lip and nose to allow the lever means to be pivoted along an axis generally parallel to a tangent of said side wall whereby when the lip is moved away from said side wall the nose moves into said portion of the side wall deforming said portion of the side wall and breaking said ampule means.

6. An aerosol dispenser comprising: a container having a deformable side wall and an internal chamber for storing a propellant and at least one first component to be sprayed therefrom, normally closed valve means mounted on said container to retain the propellant and component in said chamber, said valve means being movable to an open position to dispense aerosol to a desired location, frangible ampule means located within said chamber containing a second component that is separated from the first component within the chamber until said ampule means is broken, means for holding the ampule means in said chamber adjacent a portion of the side wall of the container, and means mounted on said container engageable with said portion of the side wall and operable to deform said portion of the side wall toward the ampule means to break said ampule means thereby releasing the second component into said chamber, said means mounted on the container including lever means having a lip and a nose, and retainer means mounted on the container and connected to the lever means between the lip and nose to allow the lever means to be pivoted along an axis generally parallel to a tangent of said side wall whereby when the lip is moved away from said side wall the nose moves into said portion of the side wall deforming said portion of the side wall and breaking said ampule means, said retainer means comprises wire means surrounding said side wall in tight fit relation, said wired means being connected to said lever means to hold the lever means in engagement with the portion of the side wall of the container.

7. The dispenser of claim 6 wherein: said means for holding the ampule means in said chamber includes band means located in engagement with said side wall, said band means being aligned with said wire means.

8. The dispenser of claim 7 wherein: said band means includes means for holding the ampule means adjacent said portion of the side wall of the container.

9. An aerosol dispenser comprising: a container having a deformable wall and an internal chamber for storing a propellant and a first material, normally closed valve means mounted on said container to retain the propellant and first material in said chamber, said valve means being movable to an open position to dispense aerosol to a desired location, at least one frangible ampule means located in the chamber adjacent said deformable wall containing a second material separate from the first material, means holding the ampule means in said chamber, said means for holding the ampule means in said chamber includes band means engageable with said ampule means to hold said ampule means in said chamber adjacent said deformable wall, said band means including a loop surrounding a portion of the ampule means, a first arm and a second arm located in engagement with the inside of the wall of the container, said loop having ends joined to the first and second arms, said ends spacing the ampule means from said wall, and means engagable with said deformable wall operable to deform said wall to break said ampule means thereby release the second material into said chamber.

10. The dispenser of claim 9 wherein: said ampule means is a generally cylindrical sealed vessel having a longitudinal axis generally parallel to the longitudinal axis of the chamber.

11. The dispenser of claim 9 wherein: the means engagable with said deformable wall includes ring means surrounding said wall in general alignment with said band means, and movable means cooperating with the ring means to deform said wall to break said ampule means.

12. The dispenser of claim 11 wherein: said movable means includes a lever mounted on the ring means for movement into engagement with said deformable wall to break said ampule means.

13. The aerosol dispenser of claim 9 wherein: the means engagable with said deformable wall includes lever means having a lip and a nose, and retaining means mounted on the container and connected to the lever means between the lip and nose to allow the lever means to be pivoted along an axis generally parallel to a tangent of said wall whereby when the lip is moved away from said wall the nose moves into said wall deforming the wall and breaking said ampule means.

14. An aerosol dispenser comprising: a container having a deformable wall and an internal chamber for storing a propellant and a first material, normally closed valve means mounted on said container to retain the propellant and first material in said chamber, said valve means being moveable to an open position to dispense aerosol to a desired location, at least one frangible ampule means located in the chamber adjacent said the formable wall containing a second material separate from the first material, means holding the ampule means in said chamber, and means engageable with said deformable wall operable to deform said wall to break said ampule means thereby release the second material into said chamber, said means engageable with said deformable wall includes lever means having a lip and a nose, and retaining means mounted on the container and connected to the lever means to allow the lever means to be pivoted to move the nose into said wall deforming the wall and breaking said ampule means, said retaining means comprises means surrounding said wall in a tight fit relation, said means surrounding said wall being connected to the lever means to hold the lever means and engagement with said wall of the container.

15. The dispenser of claim 14 wherein: said means for holding the ampule means in said chamber include band means located in engagement with said wall, said band means being aligned with said means surrounding said wall.

16. The dispenser of claim 15 wherein: said band means includes means for holding the ampule means adjacent said side wall of the container.

17. An aerosol dispenser comprising: a cylindrical container having a deformable side wall and enclosed internal chamber for storing a propellant and a first fluid, a normally closed valve means to retain the propellant and first fluid in said chamber, cap means mounting said valve means in a sealed relation on said container, said valve means having a member movable to an open position to allow the fluid in the chamber to be dispensed to a desired location, frangible ampule means located in said chamber adjacent a portion of said deformable side wall containing a second fluid that is separated from the first fluid, said ampule means comprising an elongated cylindrical vessel having a longitudinal axis that is generally parallel to the longitudinal axis of the chamber of the container, said vessel having a side wall located in close relationship to the portion of the cylindrical side wall of the container, holding means located within said chamber engagable with said cylindrical side wall and said vessel for holding sad vessel in said chamber, and manually movable means located adjacent the outside of te side wall in alignment with the vessel operable to deform said side wall to break said vessel thereby release the second liquid into said chamber, and retainer means mounted on the side wall of the container for holding said movable means in engagement with the outside of the cylindrical side wall of the container, said retainer means including ring means surrounding and mounted on the side wall of the container supporting said movable means.

18. The dispenser of claim 17 wherein: said means for holding the vessel in said chamber includes means having a loop surrounding a portion of the vessel to hold said vessel in said chamber adjacent said portion of the side wall.

19. The dispenser of claim 17 wherein: the manually movable means includes lever means having a lip and a nose, said retainer means being connected to the lever means between the lip and the nose to allow the lever means to be pivoted along an axis generally parallel to a tangent of said side wall whereby when the lip is moved away from said side wall the nose moves into said portion of the side wall deforming said portion of the side wall and breaking said vessel.

20. The dispenser of claim 17 wherein: said means for holding the vessel includes band means in said chamber aligned with said ring means, said band means including means holding the vessel adjacent said portion of the side wall.

21. An aerosol dispenser comprising: a container having a deformable side wall and enclosed internal chamber for storing a propellant and a first fluid, normally closed valve means mounted on the container to retain the propellant and first material in said chamber, said valve means movable to an open position to allow the fluid and propellant in the chamber to be dispensed to a desired location, frangible ampule means located in said chamber adjacent a portion of said deformable side wall containing a second fluid that is separated from the first fluid, said ampaule means having a wall located in close relationship to the portion of side wall of the container, holding means located within said chamber for holding said ampule means in said chamber, manually movable means located adjacent the outside of the side wall of the container in alignment with the wall of the ampule means operable to deform said side wall of the container to break said ampule means to thereby release the second liquid into said chamber, and retainer means for holding said movable means in engagement with the outside of the side wall of the container, said retainer means including ring means surrounding and mounted on the side wall of the container supporting said movable means.

22. The dispenser of claim 21 wherein: said means for holding the ampule means in said chamber includes means generally aligned with the ring means having a loop surrounding a portion of the ampule means to hold said ampule means in said chamber adjacent said portion of the side wall.

23. The dispenser of claim 21 wherein: the manually movable means includes lever means having a lip and a nose, said ring means being connected to the lever means between the lip and the nose to allow the lever means to be pivoted along an axis generally parallel to a tangent of said side wall whereby when the lip is moved away from said side wall the nose moves into said portion of the side wall deforming said portion of the side wall and breaking said ampule means.

24. The dispenser of claim 21 wherein: said holding means includes band means aligned with said ring means.

25. The dispenser of claim 21 wherein: said movable means includes a lever mounted on the ring means for movement into engagement with said deformable wall to break said ampule means.

* * * * *